United States Patent [19]

King, Jr. et al.

[11] 4,222,254

[45] Sep. 16, 1980

[54] GAUGE CONTROL USING ESTIMATE OF ROLL ECCENTRICITY

[75] Inventors: Eugene O. King, Jr., Murrysville; D. Fred Stewart, Monroeville, both of Pa.

[73] Assignee: Aluminum Company of America, Pittsburgh, Pa.

[21] Appl. No.: 19,580

[22] Filed: Mar. 12, 1979

[51] Int. Cl.[3] ..... B21B 37/08

[52] U.S. Cl. ..... 72/8

[58] Field of Search ..... 72/6, 8, 10, 11, 16, 72/19, 21

[56] References Cited

U.S. PATENT DOCUMENTS

| | | | |
|---|---|---|---|
| 3,709,009 | 1/1973 | Shiozaki et al. | 72/8 |
| 3,928,994 | 12/1975 | Ichiryu et al. | 72/8 |

*Primary Examiner*—Milton S. Mehr

*Attorney, Agent, or Firm*—Elroy Strickland

[57] ABSTRACT

A method of controlling a rolling mill in which eccentricity of the roll assemblies of the mill and variations in the thickness and/or hardness of material entering the mill ordinarily adversely affect the gauge of the material leaving the mill. The method involves the steps of slowly eliminating the cyclic effects of roll eccentricity on the exit gauge of the material while simultaneously correcting for the adverse effects of incoming gauge variations. This is accomplished by continually estimating a change in exit gauge using the standard gaugemeter equation but correcting the equation with continuing estimates of backup roll eccentricity, until the cyclic effects of such on exit gauge are essentially reduced to zero.

3 Claims, 4 Drawing Figures

GAUGE CONTROL USING ESTIMATE OF ROLL ECCENTRICITY

BACKGROUND OF THE INVENTION

The present invention relates generally to the control of rolling mills, and particularly to a method of reducing cyclic effects on the gauge of material rolled in a mill caused by eccentric roll assemblies of the mill while simultaneously and transiently controlling and offsetting the effects of incoming variations in thickness and/or hardness of material on the gauge of the material leaving the mill.

Variations in the thickness (gauge) of material leaving a rolling mill are caused in part by errors in measuring the gauge, incoming gauge variations from previous rolling operations, variations in the hardness of the material to be rolled, and deficiencies in the control system of the mill, which include both the electrical and mechanical components of the system. For example, if one or more of the roll assemblies of the mill has an eccentric characteristic, due to say an eccentric bearing problem, or to a roll that is out-of-round, the eccentric characteristic is imprinted upon the material leaving the mill in the form of a cyclic variation in the gauge of the material. The period of this cycle variation in gauge is that of the circumference of the eccentric roll assembly.

In U.S. Pat. No. 3,709,009 to Shiozaki et al, a system is disclosed in which rolling pressure is sampled for the purpose of calculating roll eccentricity and the phase angle of the eccentricity, using Fourier series of a function. These calculations are then employed to correct for such eccentricity by adjusting rolling pressure in response to the eccentricity such that the material reduced in thickness in the mill is substantially free of cyclic variations in rolling force, which has an effect on exit gauge.

Similar concepts and techniques are employed in U.S. Pat. No. 2,950,435 to Locher et al and in U.S. Pat. Nos. 3,242,341 and 3,496,344 to Chope.

In none of the above patents, however, is there an attempt to transiently control the mill in terms of both periodic and non-periodic variations in the material rolled. In the Shiozaki et al patent, for example, reference is made to the standard gaugemeter equation, but the system employed uses an equation in which the pressure or force ΔP at which the material is rolled is solved to make corrections for roll eccentricity. This is accomplished by use of a combination of roll force and actuator position measurements, as opposed to an actual gauge measurement, since such a combination is an available indication that is instantaneously related to the gauge of material exiting the bite of the rolls. Actual gauge measurement, in the art, is made by a thickness measuring instrument located some distance from the roll bite. There is thus a delay or transport time between the occurrence of a gauge change and the time it is detected by the instrument.

Instantaneous indications of rolling pressure or force (ΔF) can be employed to calculate instantaneous exit gauge by use of the well-known gaugemeter equation $$\Delta h=(\Delta F/M)=\Delta S$$

where

Δh is a change in exit gauge,

ΔF is a change in total rolling force or pressure,

ΔS is a change in the position of the screws or cylinders of the mill, and

M (or K) is the modulus of elasticity of the rolling mill. The fraction ΔF/M or ΔF/K is a measure of the "stretch" of the housing of the stand of the rolling mill and the compression of the roll assemblies of the stand in the process of reducing the thickness of material directed through the stand.

However, the gaugemeter equation above, and the system employed by Shiozaki et al, for example, have no means to distinguish between "in stack" eccentricity problems and variations in the thickness and/or hardness of the material entering the mill or to employ the two variations to reproduce a total transient load variation in a predictive manner so as to eliminate their combined effect on exit gauge.

BRIEF SUMMARY OF THE INVENTION

The present invention solves this problem by combining the variations of roll eccentricity and the variations in incoming gauge and/or hardness such that their detrimental effects on exit gauge are cancelled and rolled material is produced that closely conforms to the "tight" gauge tolerances desired by both the manufacturer and the customer of the rolled material. This is accomplished by estimating a change in the gauge Δh of the material entering a rolling mill by use of the standard gaugement equation $$\Delta h=\Delta S+(\Delta F/M) \quad (1)$$

estimating the eccentricity E of the roll assemblies of the mill, and correcting the equation with the estimate of eccentricity in accordance with the equation $$\Delta h=E+\Delta S+(\Delta F/M) \quad (2)$$

The eccentricity component in the equation is an estimate, and is derived mathematically in the present invention, because the component is not otherwise readily observable. Changes in the gauge and hardness of the material entering the mill effect the force component, as does eccentricity, and more than one roll of the mill may be contributing to the component, hence, the difficulty in observing the component.

The estimating of gauge and eccentricity, using control means associated with the mill, as described in detail hereinafter, is a continuing process until the cyclic component in exit gauge variations is reduced to a minimum or zero amount and the estimate of eccentricity reaches a steady state value representing the true eccentricity of the rolls. Thereafter the estimate of gauge is employed to offset the effects of incoming variations in gauge and hardness on exit gauge and to update any changes that occur in eccentricity while the estimate of eccentricity is employed to offset roll eccentricity.

THE DRAWINGS

The invention, along with its advantages and objectives, will best be understood from the following detailed description and the accompanying drawings in which.

PREFERRED EMBODIMENT OF THE INVENTION

Figure 1:
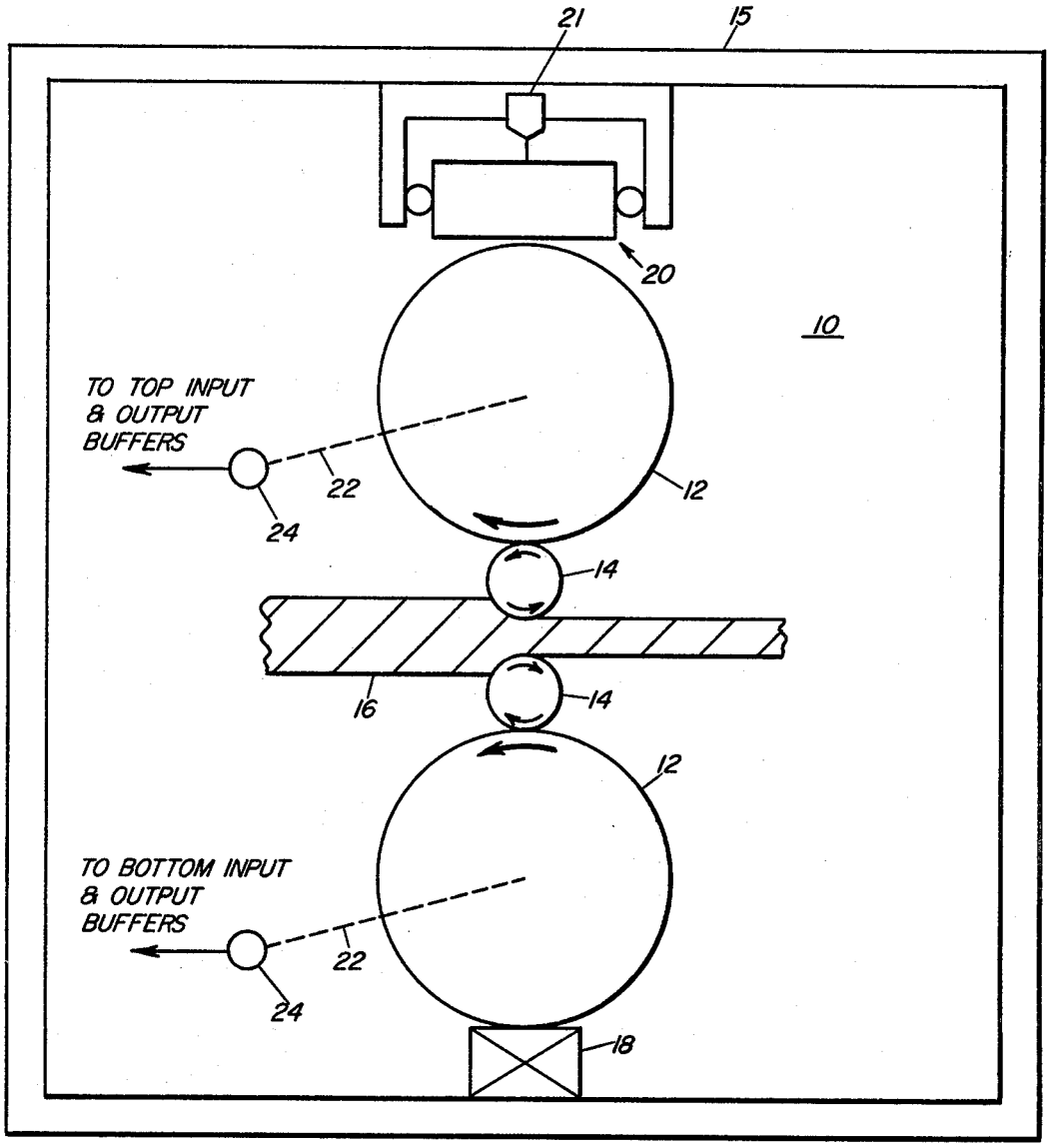
FIG. 1 is a diagrammatic view of a rolling mill.

Referring now to FIG. 1 of the drawings, a "four high" rolling mill 10 shown diagrammatically, such a mill having two large backup roll assemblies 12, which bear upon two smaller work roll assemblies 14, within a housing 15. When directed between the work rolls, a metal material 16 is reduced in thickness, as shown. Mill 10 is also representative of a multistand arrangement in which material 16 is progressively reduced in thickness in a plurality of rolling mill stands.

18, as shown in FIG. 1, is representative of a means capable of measuring rolling force, and to provide a continuing indication of the load at which a material (16) is reduced in thickness in mill 10. For purposes of illustration, 18 is shown located between the lowermost roll 12 and the lower portion of housing 15.

At the upper portion of the mill depicted in FIG. 1 is a schematic representation of the cylinders or screws 20 of the mill. Since such means are operative to position the rolls of the mill against material 16 in the process of rolling and reducing the thickness thereof, 20 will be referred to hereinafter simply as the actuator of the mill. Associated with the actuator is a device (transducer) 21 for sensing the position of the actuator. Such a device may be a linear voltage differential transformer, a linear magnetic device, or other suitable position sensing means, which are commercially available.

With continuing reference to mill 10, the backup rolls 12 are shown with respective shafts 22 (as dash lines) in the drawings, with each shaft having a transducer or encoder 24 adapted to indicate the rotational position of each backup roll. Transducers 24 accomplish this by producing a predetermined number of distinct electrical pulses for each complete revolution of their respective rolls.

Figure 2:
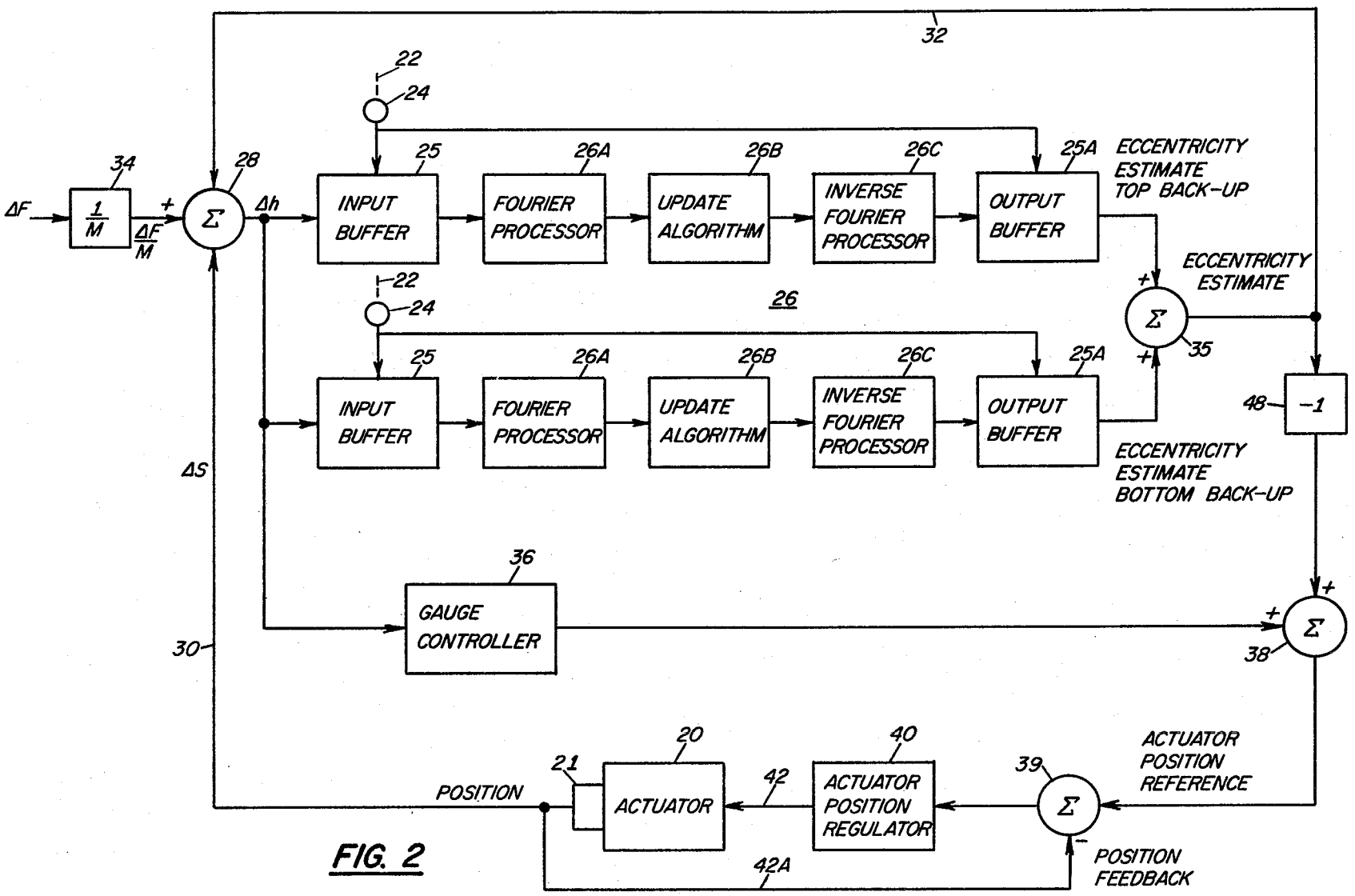
FIG. 2 is a diagrammatic representation of the control method and arrangement of the invention.

The pulse generating transducers 24, in turn, are shown in FIG. 2 electrically connected to two input and two output buffers 25 and 25A (one for each transducer 24) of a digital computer, generally designated by numeral 26. The computer is capable of storing, processing and updating gauge estimate signals in a manner explained hereinafter. The functions performed by the computer can be implemented by different types of computers or specialized electronic hardware. Not visible in FIG. 2, for example, but contained within computer 26, is a program that instructs the computer to perform the functions described in detail hereinafter.

On the left-hand side of the arrangement shown in FIG. 2 of the drawings is a summing junction 28. Connected to this junction, via line 30, is the output from sensing means 21 associated with actuator 20. Similarly, a line 32 connects the output of computer 26 to 28, while load cell 18 is connected to 28 via box 34 showing the relationship of rolling force $\Delta F$ to the modulus of elasticity M of the rolling mill 10. Since two backup rolls, with two associated computing systems are involved, as shown in FIG. 2, the output of the computer is a summation of signals from the output buffers of the systems, as shown at junction 35 in FIG. 2.

The output of summing amplifier 28 is connected to input buffers 25 of computer 26, continuing with FIG. 2, and to a gauge controller device 36. Controller 36 is preferably the well-known PI (proportional+integral) type controller, though other types of controllers can be used. The output of the gauge controller is connected to a second summing junction 38, along with the output of the computer, from junction 35. The output of 38 is, in turn, directed to a summing junction 39, and the output of 39 is connected to the input of an actuator position regulator 40. Regulator 40 regulates the position of actuator 20, as schematically indicated by line 42 in FIG. 2 connecting 40 to 20. If mill 10 employs hydraulic cylinders to locate the rolls against the material to be rolled, then regulator 40 is a valve structure operative to control the flow of actuating fluid to the cylinders to regulate the position of the cylinders in response to the output from summing junction 38. In addition, as shown in FIG. 2, the output of the sensor 21, associated with actuator 20 is fed back, via line 42A, to summing junction 39.

The operation of the arrangement shown in the figures is employed to estimate changes in the gauge $\Delta h$ of the material 16 being rolled in a mill by correcting the above standard gaugemeter equation (1) with an estimate of eccentricity E, as briefly explained above.

More particularly, the step of estimating gauge involves the use of computer 26 which samples gauge data from junction 28 in synchronism with the rolls of mill 10. For each complete revolution of backup rolls 12, transducers 24 produce a predetermined plurality of consecutive pulses. Hence, depending upon the size (diameter) of the backup rolls and the number of pulses generated by 24 for a complete revolution of each backup roll, each individual pulse represents a position increment of each backup roll in the process of the roll completing a revolution. This is best seen in the graph of FIG. 4*a*, the undulating curve in the graph being a plot of the increments of revolution against the gauge $\Delta h$ of material 16 in mill 10. The undulating character of the curve indicates the variations in the material thickness (gauge) that are involved in estimating the gauge in the present invention.

Each time one of the pulses from 24 reaches the buffers of the computer, a gauge sample estimate $\Delta h$ (developed in a manner presently to be explained) enters both input buffers 25 of computer 26 from 28, as directed by each of the encoders 24 driven by the top and bottom backup rolls 12. Buffers 25 count the gauge samples from 28, and when the number of samples for one complete revolution of the backup rolls has entered and been stored in the buffers of 26, the computer produces a trigger pulse which causes the transfer of this block of gauge data from the input buffers to the processing area of the computer (presently to be explained in detail), while the input buffers begin again to collect and store gauge samples from 28 for the next revolution of the backup rolls. The signals entering the processing area of the computer are thus revolution-based, i.e., based upon the time it takes to complete one revolution of each backup roll, as indicated in FIG. 4*a*.

Figure 4:
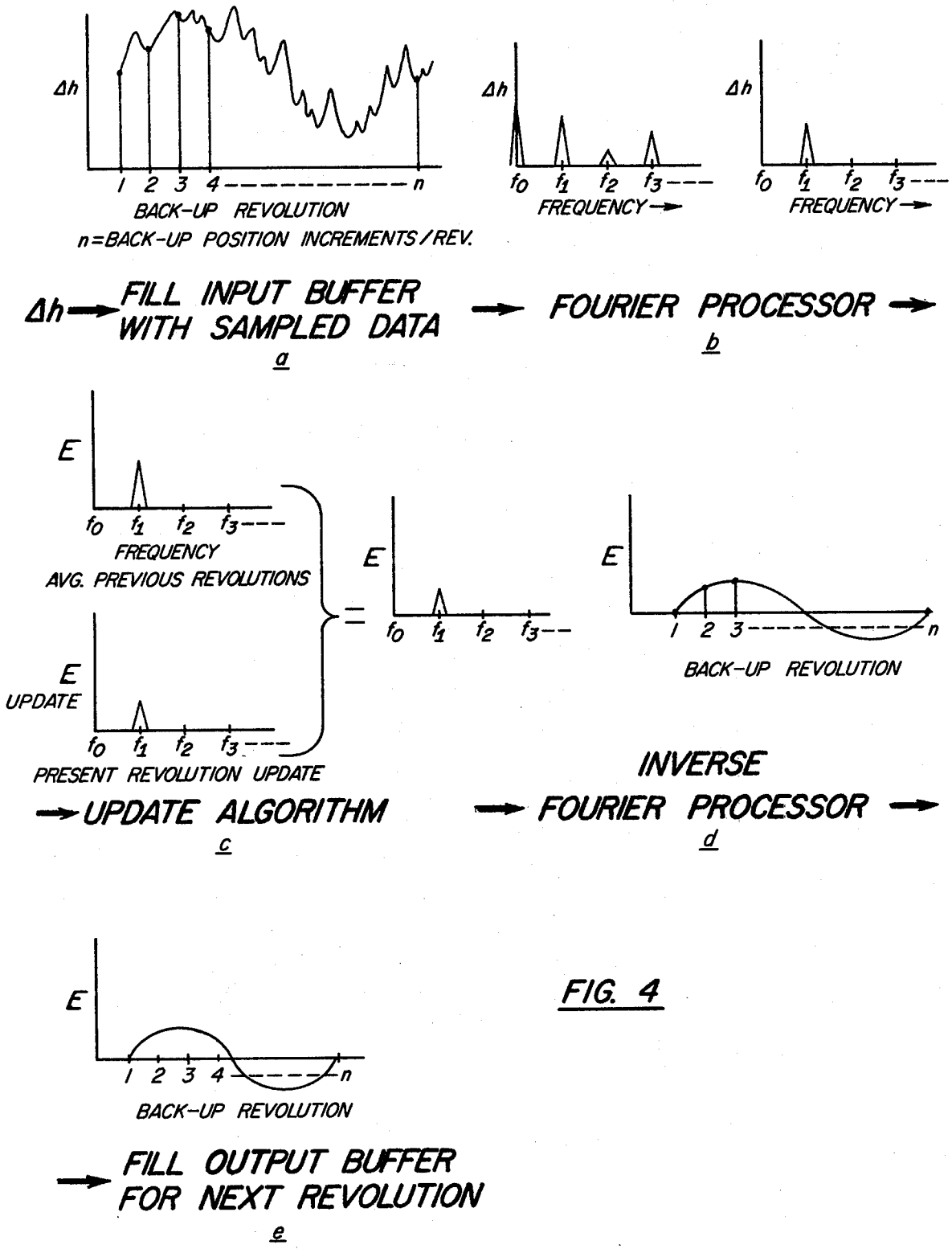
FIG. 4 is a set of steps employed in the eccentricity estimation routine of the invention along with characterizations of the signals at each step, as the estimated gauge signal is processed to derive an estimate of eccentricity.

In the processing area of the computer, the block of gauge data for each backup roll is processed by a Fourier Transform algorithm (boxes 26A, labeled Fourier Processor), which characterizes the data as a set of separate and distinct frequencies (from $f_0$, $f_1$, $f_2$—$f_n$) as shown in FIG. 4*b* instead of the time base signals of the pulse generators and the curve in FIG. 4*a*. Since exactly one revolution of the data was collected in the buffers, and transferred to and transformed by the algorithm, the value of the second term $f_1$ of the transform corresponds to a sinusoid having the same wavelength (fundamental) as the circumference of the backup rolls, as presented in FIG. 4. The first term of the transform, $f_0$, is the DC component of the sampled gauge estimate in FIG. 4*a*; the third term $f_2$ of the transform corresponds to a sine wave having one-half the wavelength of the backup circumferences (first harmonic).

Usually, the predominant backup eccentricity disturbances are related to the fundamental of the backup rolls. For this reason and for the sake of clarity, the remainder of the discussion will consider only estimating the periodic changes in gauge related to the fundamental function. The work roll assemblies (14) of a mill generally do not have eccentric problems. Hence, they are not considered in the present analysis. However, the same techniques would apply to work roll eccentricity problems.

With the gauge estimate $\Delta h$ now in the frequency domain, as shown in FIG. 4*b*, the fundamental $f_1$ of the transform can be saved and all other frequency terms set to zero. The amplitude of this component of the transform is indicative of the presence of cyclic, eccentricity-related variations in the gauge or thickness of the material rolled. Computer 26 uses this amplitude to initiate an estimate E of the eccentricity of roll assemblies 12. This estimate is the combination of the eccentricities of the two rolls 12, as both transducers 24 control the sampling of data from 28, and the changes in the gauge and hardness of the material entering the mill.

Figure 3:
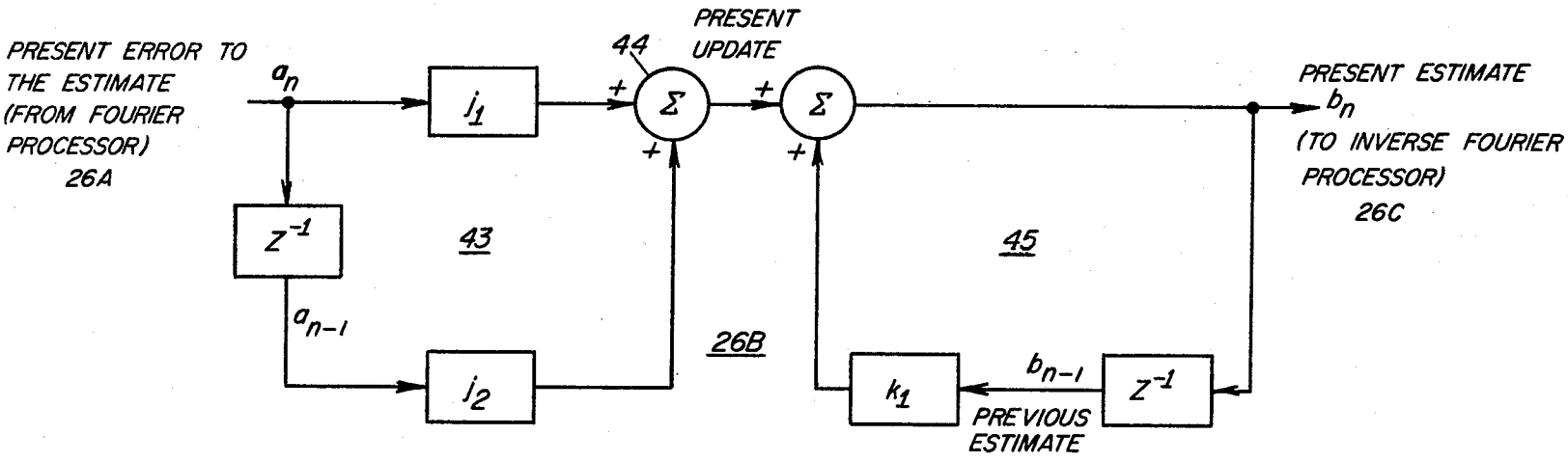
FIG. 3 is a computer algorithm employed in the arrangement of FIG. 2 for updating estimates of the eccentricity in the backup roll assemblies of the mill of FIG. 1.

The estimate E is calculated by computer 26 using the update algorithm shown in FIG. 3. (In FIG. 2, the algorithm is represented only by box 26B.) The algorithm in FIG. 3 employs the following equation $$b_n = k_1 b_{n-1} + (j_1 a_n + j_2 a_{n-1}) \quad (3)$$

with

- $a_n$ being the present error in the estimate of eccentricity
- $a_{n-1}$ being the previous update of the transform in 26B
- $b_n$ being the present eccentricity estimate of rolls 12
- $b_{n-1}$ being the eccentricity estimate of the previous revolution of rolls 12, while
- $k_1$, $j_1$ and $j_2$ are tuning constants employed in the process of implementing the correction effected by the algorithm.

As shown in FIG. 3, any error $a_n$ present in the frequency components of the transform from Fourier processors 26A is updated in a first loop 43 of the algorithm. This is accomplished by a delay operator $Z^{-1}$ in the algorithm which serves to postpone the addition (at junction 44) of the present error ($a_n$) in the estimate and the previous value of the update $a_{n-1}$ effected in 43 for one revolution of backup rolls 12. In this manner, the delay function provides an output ($a_{n-1}$) that is its previous input so that the summing function at 44 continually converges the updating values to a correct, steady state value.

A second loop 45 of the algorithm of FIG. 3 is an estimate loop which provides a present estimate of eccentricity $b_n$ based upon the output of update loop 43. Again, a delay operator $Z^{-1}$ in loop 45 provides memory for the update process so that the next estimate of eccentricity is dependent on the previous estimate. In this manner, the process works its way toward a steady state value, to systemmatically correct the previous estimates of the eccentricity. The updating and estimating performed by the update algorithm are graphically shown by fundamental frequency curves of FIG. 4*c*.

This estimate of the fundamental frequency is modified in the above manner by, and stored for each period of the revolutions of 24, in portion 26B of computer 26. Upon completion of each revolution, the computer again orders release of the data from 26B to output buffers 25B of the computer via an inverse algorithm 26C. In this manner, a correction for eccentricity is built by successively updating output buffers 25A, as they receive the information provided by the algorithm of 26B via the inverse algorithm of 26C.

The estimate of eccentricity provided and stored in 26B is transformed again by an inverse algorithm of two Fourier Transforms labeled 26C in FIG. 2. 26C returns or reconverts the frequency components developed in 26A to a revolution-based signal defined (again) by the predetermined number of pulses from transducers 24 occurring with one complete rotation of backup rolls 12. Graphically, this is shown in FIG. 4*d* of the drawings.

The process afforded by the algorithm of 26B continues to reestimate the eccentricity of backup rolls 12 until there are no significant cyclic variations present in the gaugemeter equation and hence in the material exiting mill 10. This is accomplished in the following manner.

As shown in FIG. 2, the outputs of pulse generators 24 are directed simulataneously to both buffers 25 and 25A, which accumulate gauge data ($\Delta h$) from 28 for each revolution of the backup rolls, as indicated graphically in FIGS. 4*a* and 4*e*. At the completion of each revolution, with 26 counting the pulses from transducer 24, 26 orders release of the data from output buffers 25A to junction 35. Hence, an estimate of eccentricity E is produced by and directed from the computer for each revolution of 12 and 24.

From 25A the estimate of eccentricity E is combined at 35 and directed to summing junction 28, via line 32, and thereby employed in calculating exit gauge estimate $\Delta h$ using the above gaugemeter equation (2). The estimate of eccentricity is also employed to offset the effect of eccentricity on gauge, but the offsetting action is not limited to eccentricity. Rather, it includes the effects on the mill due to changes in the gauge and/or hardness of material 16 entering the mill. This is accomplished again through the use of equation (2), as it is employed in summing junction 28 in the manner explained below.

As discussed earlier, load indicating means 18 produces a signal and a change in signal (voltage) which is a measure of the "stretch" $\Delta F/M$ of the housing 15 of mill 10, and the compression of the mill rolls, as the load $\Delta F$ on the mill stand is affected by roll eccentricity and variations in incoming gauge and hardness. The relationship of rolling force $\Delta F$ to the modulus of elasticity M of the mill is indicated in box 34 which is located in the connection of 18 to summing junction 28.

Junction 28 continually receives signals from 18, providing the roll force measurement $\Delta F$, from actuator position indicator 21 (via line 30), providing the position measurement $\Delta S$ of actuator 20, and from computer 26, providing the estimate of roll eccentricity E, as 28 continuously adds these signals using equation (2) to provide an output $\Delta h$ which is an estimate of the gauge of material 16 leaving the mill.

The output of 28 is, in turn, continuously directed to computer 26 and to gauge controller 36. The computer continues to sample and analyze Δh for eccentricity components in the manner described above, while controller 36 operates to order changes in actuator regulator 40 in accordance with the latest estimate of gauge and the latest estimate of eccentricity, as the two estimates are combined in summing junction 38. 38 provides a reference signal for regulator 40 at junction 39, which functions to change actuator 20 in accordance with any difference occurring between the output of 38 and that of sensor 21, the output of which is fed back to 39 over line 42A. In this manner, the estimates in gauge and eccentricity are employed to correct for force changes ΔF caused by both roll eccentricity and incoming variations in gauge and/or hardness of material 16.

It will be noted in FIG. 2 that the output (estimated E) from 35 is inverted, as indicated by box 48 so that the eccentricity component of the reference signal for actuator regulator 40 is inverted such that the actuator position is regulated in an equal but opposite direction, as the estimated eccentricity, which results in the cancellation of the eccentricity effects on the material 16. The signal inversion that takes place as denoted by box 48 can be accomplished either in the computer 26 or by conventional methods in electronic hardware such as an operational amplifier circuit. In either case, such a process follows the rotation of the backup rolls and anticipates the changes in gauge caused by an eccentric roll assembly so that the mill stand is "softened" for the eccentric component that would ordinarily cyclically change the gauge of the material in the mill. In this manner, the cyclic variations in exit gauge of mterial 16 are thereby removed as the material proceeds through the mill.

To the extent that the eccentricity has been correctly estimated and the cyclic component in exit gauge variations removed, the update $a_n$ (FIG. 3) or error in equation 3, with each subsequent block of data, as processed in 26, is progressively reduced, i.e., the update of or error in each estimate in 26B converges to zero. At such a point in time, the estimate E will be an accurate steady state representation of the eccentricity of backup rolls 12.

As the estimate of eccentricity E works its way to a steady state value, the changes in estimated gauge Δh from summing junction 28 will increasingly become those caused only by the changes in the gauge and/or hardness of material 16 entering the mill. When E reaches a steady state value, the gaugemeter equation and summing amplifier 28 then operate to correct for such incoming changes only, as the estimate of gauge Δh entering computer 26 will have the steady state value of E returning to 28 (via 32) from the computer. Similarly, the Δh signal directed to controller 36 and the signal available at summing amplifier 38 will hence have the steady state E component. The Δh signal from controller 36 then functions only to order changes in actuator 20 of the mill in offsetting response to variations in the gauge and/or hardness of material 16 entering mill 10, while the steady state estimate of eccentricity supplied to 38 continues to function to control the mill in a manner that offsets the eccentricity of the backup rolls.

While the invention has been described in terms of preferred embodiments, the claims appended thereto are intended to encompass all embodiments which fall within the spirit of the invention.

Having thus described the invention and certain embodiments thereof, what is claimed is:

1. A method of controlling a rolling mill in which eccentricity of one or more of the roll assemblies of the mill and variations in thickness and/or hardness of material entering the mill ordinarily cause variations in the gauge of the material that exits from the mill, the eccentricity of the roll assembly or assemblies providing the material exiting the mill with a cyclic component, while the entering variations in thickness and/or hardness of the material provide the material exiting the mill with other transient components, the method comprising the steps of estimating a change in material gauge Δh by use of the standard gaugemeter equation $$\Delta h = \Delta S + (\Delta F/K)$$

estimating the eccentricity E of the roll assemblies of the mill, correcting the gaugemeter equation with the estimate of eccentricity in accordance with the equation $$\Delta h = E + \Delta S + (\Delta F/K)$$

until the cyclic component in exit gauge variation is reduced to a minimum or zero amount and the estimate of eccentricity in the equation thereby converges to a steady state value, and simultaneously processing and applying the estimate of gauge Δh in a manner that reduces the transient components in exit gauge to a minimum amount.

2. The method of claim 1 including the step of continuing to use the steady state estimate of eccentricity to offset the actual eccentricity of the roll assemblies.

3. A method of controlling a rolling mill having means operative to control the working space between the rolls of the mill and the force at which material is reduced in thickness in said space by said rolls, the method comprising the steps of directing material through said space;

measuring a change in force ΔF at which the rolls engage the material;

measuring a change in housing stretch or compression ΔF/K of the rolling assemblies due to a change in the position ΔS of the means operative to control the working space and force;

estimating a change in material thickness Δh from the standard gaugemeter equation $$\Delta h = \Delta S + (\Delta F/K)$$

providing samples of the estimate of the change in thickness during the period of time defined by a revolution of the rolls;

processing the samples of the estimate of material thickness by use of a Fourier Transform function that converts the samples to a set of distinct, thickness-representing frequencies, the amplitudes of which are indicative of variations of the thickness and/or hardness of the material entering the rolls and of a cyclic component in material thickness resulting from the eccentricity of the rolls of the mill;

estimating the eccentricity E of the rolls from the amplitudes of the thickness-representing frequencies;

processing the estimate of roll eccentricity by use of an Inverse Fourier Transform function that reconverts the thickness-representing frequencies to a time base indication defined again by a revolution of the rolls;

using this estimate of eccentricity to change the position of the means operative to control the working space and force in a manner that tends to offset the effects of roll eccentricity on the thickness of the material leaving the rolls;

using this estimate of eccentricity to correct the above gaugemeter equation for eccentricity in the following manner $$\Delta h = \Delta S + E + (\Delta F/K);$$

using the result of this correction to change the means for controlling the working space and force in response to variations in the thickness and/or hardness of the material entering the rolls in a manner that offsets such variations on the thickness of the material leaving the rolls; and reestimating roll eccentricity for controlling and updating the estimate of material thickness $\Delta h$ until the cyclic component is reduced to essentially zero in the gaugemeter equation and in the thickness of the material leaving the rolls.

* * * * *